United States Patent [19]

McLain et al.

[11] 4,168,137

[45] Sep. 18, 1979

[54] TRIAXIAL TABLET COMPRESSOR MACHINE

[75] Inventors: Donald E. McLain; Robert E. Melson, both of Portage; Chester C. Sperry, Kalamazoo, all of Mich.

[73] Assignee: The Upjohn Company, Kalamazoo, Mich.

[21] Appl. No.: 884,686

[22] Filed: Mar. 8, 1978

[51] Int. Cl.[2] ..... B30B 5/02; B30B 11/08

[52] U.S. Cl. ..... 425/405 H; 425/345; 425/352

[58] Field of Search ..... 425/78, 345, 352, 353, 425/354, 355, 405 H

[56] References Cited

U.S. PATENT DOCUMENTS

| | | | |
|---|---|---|---|
| 2,326,381 | 8/1943 | Milligan et al. | 425/405 H X |
| 2,582,922 | 1/1952 | Crowley et al. | 425/405 H X |
| 3,103,699 | 9/1963 | Gerard et al. | 425/405 H X |
| 3,200,442 | 8/1965 | Haller | 425/354 X |
| 3,318,265 | 5/1967 | Winters et al. | 425/345 |
| 3,720,491 | 3/1973 | Dedek | 425/352 X |

*Primary Examiner*—J. Howard Flint, Jr.
*Attorney, Agent, or Firm*—Blanchard, Flynn, Thiel, Boutell & Tanis

[57] ABSTRACT

Mechanism for applying radially directed compression pressure onto pharmaceutical materials in a tableting die. There is provided mechanism for association with an otherwise standard tableting machine by which a radially directed pressure is applied to the tableting materials, usually powders, within a tableting die in order to minimize the tendency for capping or delaminating in the finished tablet. A relatively heavy housing is introduced as a component portion of the strain rod which otherwise extends uninterruptedly from the top to the bottom of the machine adjacent the rotating die table at the portion of the travel thereof occupied by the compression rollers. Separate strain rod components are connected from the top of the machine to the top of said housing and from the bottom of said housing to the bottom of the machine so that the strain of a normal compression operation axially of a die is caused to pass through said housing. The housing also contains a laterally directed, suitably spring-backed, roller which engages radially arranged punches for applying the desired radial pressure to a given die simultaneously with the application thereto of a conventional axially directed compression pressure. Means are also provided for adjustment of the magnitude of said laterally applied pressure as desired.

6 Claims, 7 Drawing Figures

FIG. I
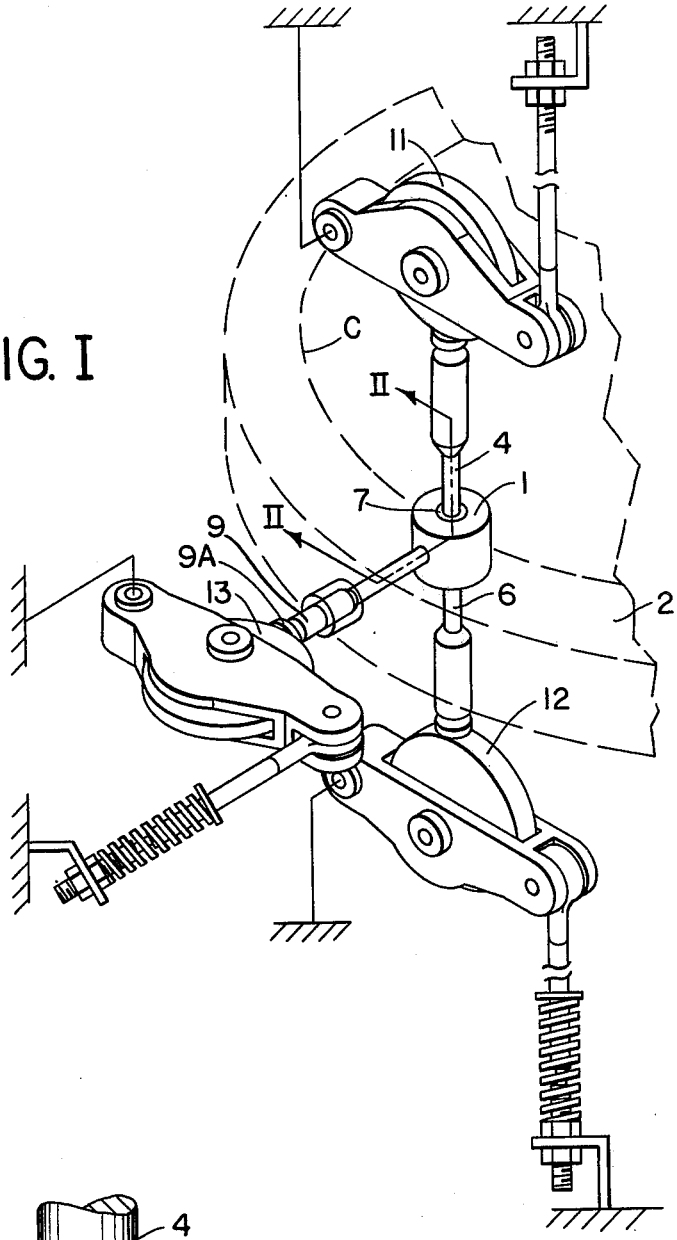
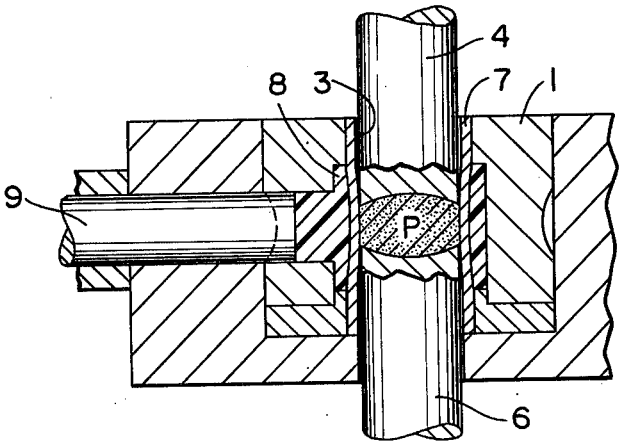
FIG. II

FIG. 4
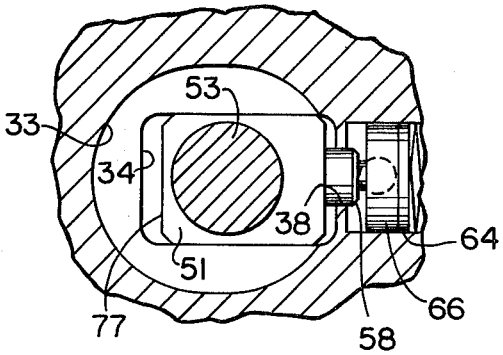
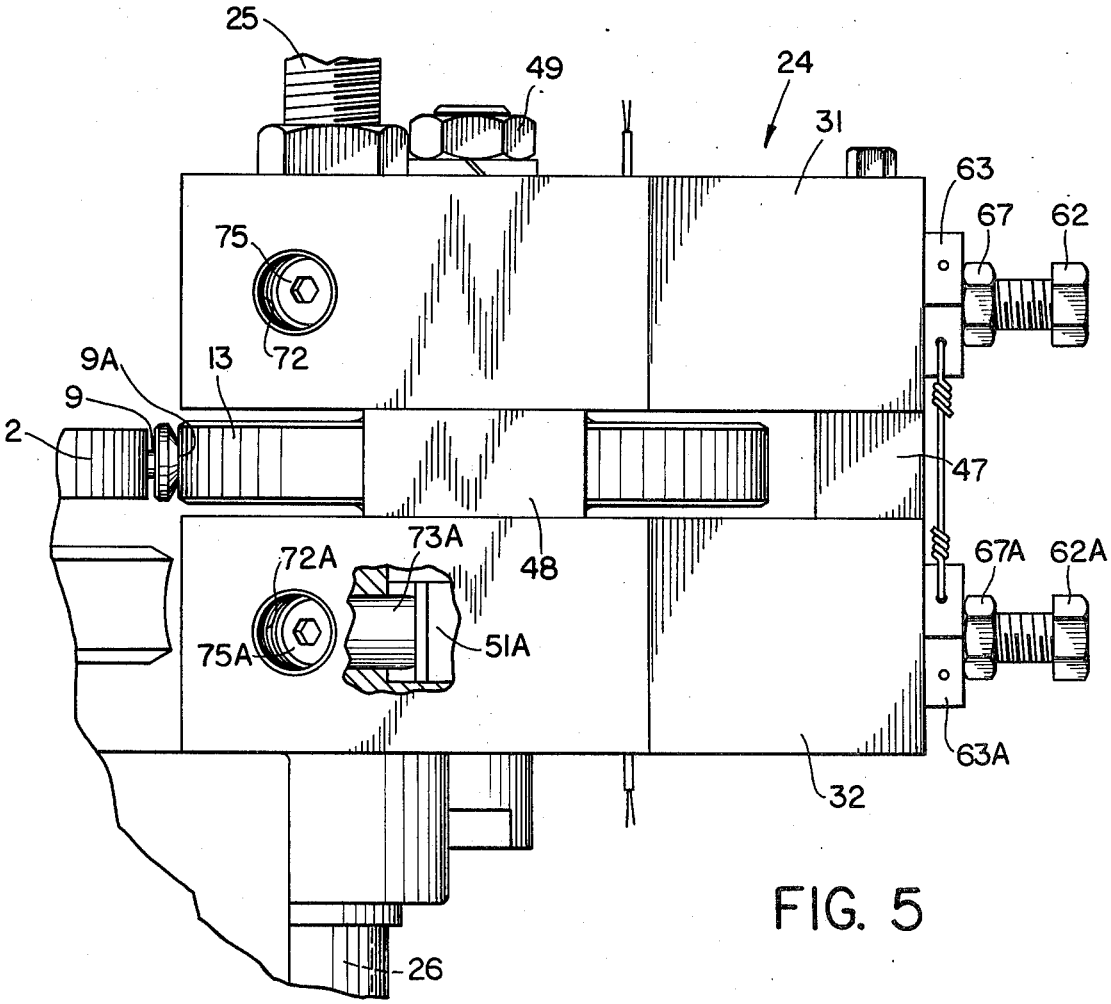
FIG. 5

TRIAXIAL TABLET COMPRESSOR MACHINE

FIELD OF THE INVENTION

This invention relates to apparatus for applying to an otherwise conventional tableting die a radially directed compression pressure at least substantially simultaneously with the application thereto of the usual axially directed compression pressure. In particular, this invention provides specific mechanism for carrying out the objectives of apparatus schematically illustrated in the application of Everett N. Hiestand, Robert E. Melson and Chester C. Sperry entitle "TRI-AXIAL TABLET COMPRESSOR" filed on Nov. 7, 1977, U.S. Ser. No. 849,504 and assigned to the same assignee as the present application.

BACKGROUND OF THE INVENTION

In carrying forward the concepts disclosed and claimed in the above-mentioned application and particularly in converting into actual production equipment the theoretical concepts and experimental equipment upon which said application was based, a number of practical problems arose which it is the purpose of the present invention to consider and solve. In so doing, it was decided for present purposes to provide the desired laterally operative mechanism for operation in conjunction with a suitably modified rotary press, Model B-2, manufactured and sold by F. J. Stokes Corporation, 5500 Tabor Road, Philadelphia 20, Pa. In view of this, the following discussion as well as the subsequent disclosure and accompanying drawings are all in terms of said particular model and make of rotary press. It will be understood, however, that such is for illustrative purposes only and much of said mechanism is applicable with only minor if any modifications to the Model BB-2 Stokes rotary press and its broader concepts will be applicable both to other models of Stokes machines as well as to machines of the same general type made by other manufacturers.

Therefore, in considering the application of such side thrust means as is set forth in the above-identified application to the Stokes Model B-2 above mentioned, the first practical problem encountered was the fact that a strain rod ran from top to bottom of the machine at exactly the point on its periphery where the lateral pressure imposing mechanism had to be positioned.

Further, when this problem was solved by interrupting such strain rod and connecting segments thereof to the top and bottom of the housing containing the lateral force generating mechanism, it then became necessary to arrange such mechanism in such a manner that the housing could be made strong enough without excessive mass or other inconvenience to transmit the strain therethrough from the upper segment of the strain rod to the lower segment thereof.

In so doing, it was also necessary to keep in mind that the radially positioned punch as set forth in said above-identified application moves a distance of only a few thousandths of an inch to perform its desired function and hence it was necessary that the roller should be resiliently loaded in such a manner as to be effective upon such slight movement. Thus, it was necessary to build a high degree of precision into the means holding said roller inactive when in a position between successive radical punches and yet cause the mechanism to be capable of exerting the necessary high pressure, of the order of several thousand p.s.i., such as 40,000 p.s.i., when such roller came in contact with such a punch.

Accordingly, the objects of the invention include:

1. To provide specific production mechanism for carrying out the objectives of the above-identified application and the experimental apparatus on which said application was based.

2. To provide means, as aforesaid, which can be placed in the position otherwise occupied by a strain rod in the B-2 Stokes machine above-identified.

3. To provide apparatus, as aforesaid, capable of generating upon successively presented radial punches relatively high but precisely controlled pressures with only a few thousandths inch movement of the pressure imposing means.

4. To provide apparatus, as aforesaid, which will be self-contained, compact and simple, particularly so as to be capable of placement for simultaneous operation with the rollers operating the vertical punches of the above-identified F. J. Stokes Corporation machine, and others similar, without interference therewith and without excessive inconvenience to the operator.

5. To provide apparatus, as aforesaid, which can provide the desired operation of each radial punch simultaneously with the axial punches by placement of the operating means for the radial punches in radial alignment with the operating means for the axial punches.

6. To provide apparatus, as aforesaid, which will be capable of ready adjustment with simple tools and which when adjusted will remain in proper adjustment for a long period of operation.

Other objects and purposes of the invention will be apparent to persons acquainted with apparatus of this general type upon reading the following specification and inspection of the accompanying drawings.

BRIEF DESCRIPTION OF THE DRAWINGS

FIG. I is a substantial reproduction of FIG. 2 of said above-identified application placed here for convenient reference to illustrate the environment of the present invention.

FIG. II is a section taken on the line II—II of FIG. I.

FIG. 4 is a fragmentary sectional view taken on line IV—IV of FIG. 3.

FIG. 5 is a side view generally similar to FIG. 1 but showing the auxiliary mechanism of the present invention by a somewhat enlarged scale.

SUMMARY OF THE INVENTION

Figure 1:
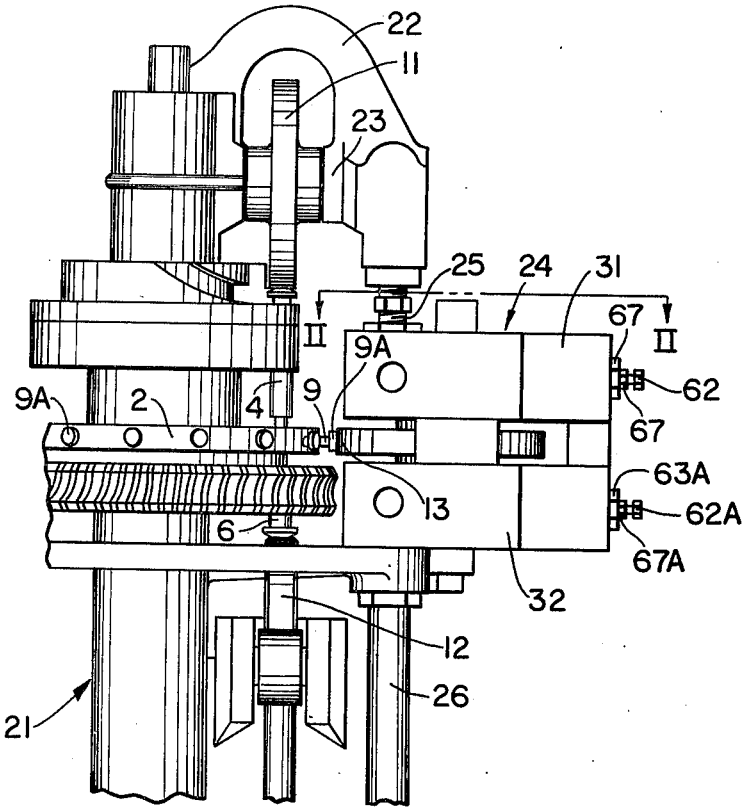
FIG. 1 is a fragmentary elevational view of the above-mentioned rotary press Model B-2 made by F. J. Stokes Corporation suitably modified by the present invention.

According to the present invention there is provided a relatively heavy housing having an internal cavity receiving a pair of sliding bearings and a roller and shaft assembly carried by said bearings. The standard strain rod positioned adjacent the compression station of the conventional rotary press is removed and a pair of segmental strain rods extending upwardly and downwardly from said housing inserted in its place. Heavy adjustable springs are provided for urging said bearings and the roller carried thereby toward the die table of the rotary press and finely adjustable means are provided for limiting the forward movement of said bearings in response to said springs. Thus, the strain from the vertical, or axial, punches of the rotary press passes via said segmental strain rods through the housing supporting said lateral roller without interference with the operation thereof and said roller will place the desired resiliently backed pressure onto the radial punches with only a very slight radial movement upon the appearance of a punch against said roller and moving it backwardly only sufficiently against said springs to lift it away from said limit means.

DETAILED DESCRIPTION

In the above-identified application there is set forth in detail a technique for preventing, or at least minimizing, the phenomena known as capping and laminating by imposing onto a suitable compression die a radially directed pressure at the same time that the conventional axial pressure for tableting purposes is applied thereto. Attention is invited thereto for the details thereof. However, for purposes of convenient reference in understanding of the present invention, a brief summary of same will be useful here.

Referring therefor to FIGS. I and II, there is provided a die 1 arranged in a suitable rotatable table 2 for the reception in an internal cylindrical cavity 3 of the pharmaceutical powders for compression by punches 4 and 6 into a suitable tablet. THe internal walls of said cavity 3 are lined and defined by a sleeve 7 which is conveniently made of steel to provide a slight radial flexibility. Said sleeve is surrounded by a pressure transmitting mass 8, as rubber, which upon radial inward movement of the radial punch 9 imposes an inwardly directed radial force onto said sleeve 7. By the proper choice of material for said resilient mass 8, such inwardly directed pressure will be substantially evenly distributed circumferentially around the sleeve and the latter will move inwardly sufficiently, as one or two thousandths of an inch, to place the desired radially, inwardly directed, and uniformly circumferentially distributed lateral or radial pressure onto the powders being compressed. By proper timing of the radial and axial punches, the occurrence of said radial pressure will be simultaneous with the appearance of the axial pressure.

In conventional equipment there will be a plurality of dies arranged on a theoretical circle C concentric with said table and each carrying its own pair of upper and lower punches. As said dies and their respective pairs of punches move upon rotation of said table between the rollers 11 and 12, appropriate axial pressure is applied thereto and the punches move against the powder which has previously been placed into a given die for compressing same into the form of a suitable pharmaceutical tablet as desired. The upper punch is subsequently withdrawn and the lower punch normally utilized for expelling the finished tablet in a conventional manner.

As set forth in the above-identified application, the radial punch 9 is similarly exposed to a radially aligned roller 13 which is positioned in radial alignment with respect to said table with the rollers 11 and 12 in order that the radial pressure be generated on the punch 9 at the same time that the axial pressure appears on the punches 4 and 6. The substance of the present invention is the mounting and control for the roller 13.

Turning now to the present invention, there is shown in FIG. 1, for illustrative purposes a portion of a rotary press made by F. J. Stokes Corporation Model B-2 as above further identified, same being conventional and well known. In this machine, a central pedestal 21 rotatably carries the die table 2 and appropriately supports the rollers 11 and 12 for imposing the above-described axial pressure onto the conventional axially directed punches 4 and 6. This machine has a yoke 22 for carrying the outboard bearing housing 23 of the upper roller 11 and in the conventional Stokes machine the outer end of this yoke is tied to the base of the machine by a strain rod. This strain rod is removed and the housing 24 further described hereinafter is positioned adjacent said upper and lower rollers 11 and 12 and segmental strain rods 25 and 26 provided. Segmental strain rod 25 connects the housing 23 of said outboard bearing to the upper side of said housing 24 and strain rod segment 26 connects the lower side of said housing 24 to an appropriate point on the base (not shown) of the machine.

Figure 3:
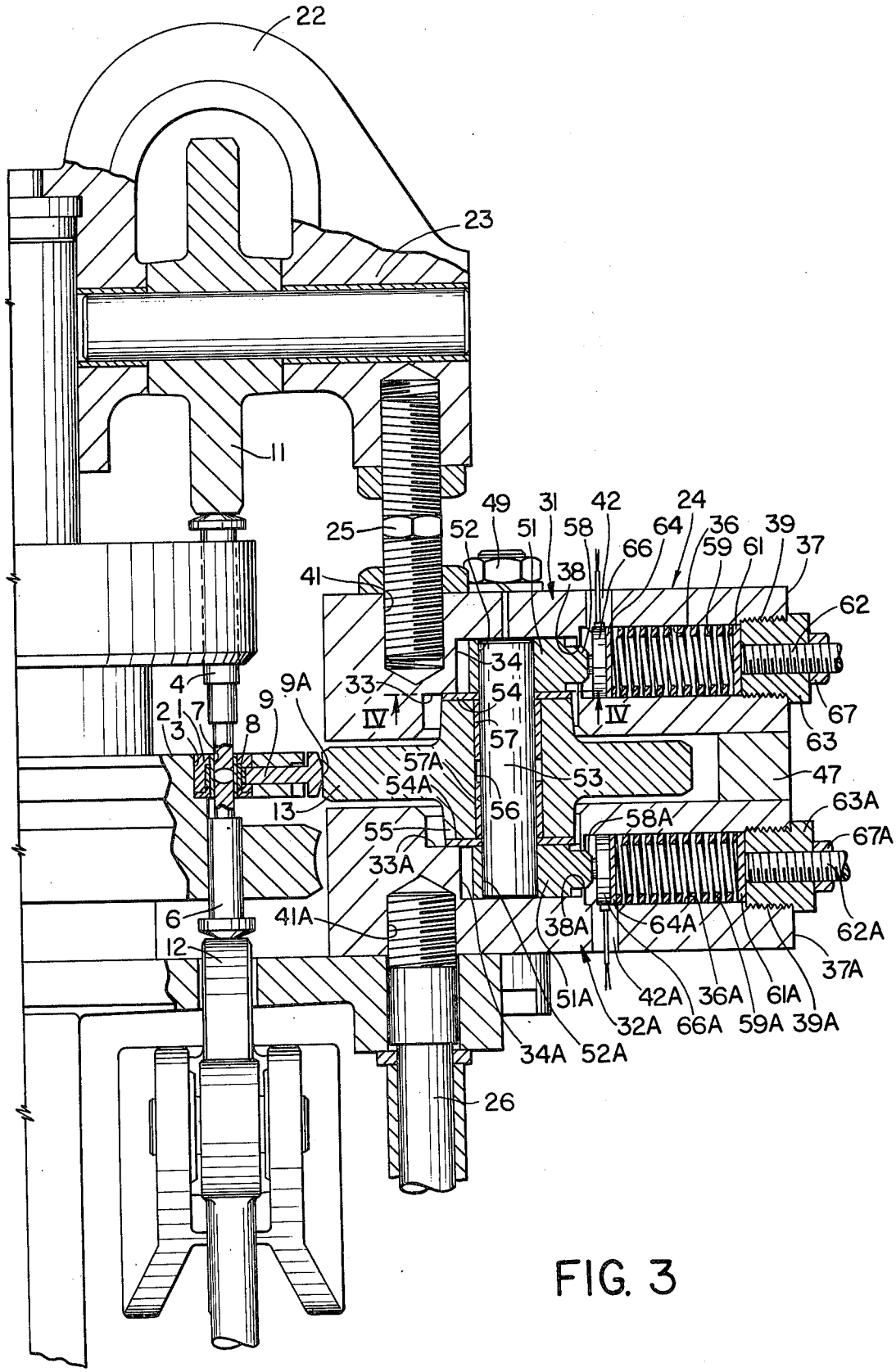
FIG. 3 is a partially elevational and partially sectional view of the apparatus as shown in FIG. 1. The sectional portions thereof are in central section and the major portion thereof is that indicated by line III—III of FIG. 2

Turning now to the details of the mounting means for the roller by which the radial pressure is imposed and parts associated therewith, there is provided for the housing 24 an upper block 31 and a lower block 32. Said upper block 31 has a recess 33 (FIGS. 3 and 4) therein which is of elongated cross section with circular ends and has a generally rectangular slot 34 at the bottom thereof. In general alignment with the major dimension of the slot 34 is a bore 36 entering from the end 37 of the block. A small opening 38 preferably circular, connects the bore 36 with the slot 34. The outer end of the bore 36 is threaded, as at 39. A threaded opening 41 is provided in said block for the reception of the upper segmental strain rod 25 as best shown in FIG. 3.

An opening 42 extends from the bore 36 to the outside of said upper block for purposes appearing further hereinafter.

The bottom block 32 is identical with said described upper block and hence the parts thereof corresponding to the upper block 31 are identified with the same reference numerals as those above used for said upper block with the suffix "A" added thereto.

The only exception is that the opening 41A is somewhat larger to accommodate the somewhat larger diameter of strain rod segment 26 as compared to the diameter of the strain rod segment 25.

Spacers 46, 47 and 48 are arranged in the locations shown for properly positioning the blocks 31 and 32 with respect to each other and are fastened therein by any suitable means, such as screws 49.

Positioned within the openings 34 and 34A are sliders 51 and 51A respectively provided with openings 52 and 52A for the nonrotatable reception therein of the pin 53. Said pin carries thereon the thrust bearings 54 and 54A. The roller 13 encircles the pin 53 by its hub 55 whose ends bear against the thrust bearings 54 and 54A. Said roller has an internal opening 56 into which are pressed the bushings 57 and 57A, said bushings being in rotatable contact with and being supported by the pin 53.

Sliders 51 and 51A respectively are provided with extension portions 58 and 58A which respectively extend through the openings 38 and 38A. Resilient members, here coil springs 59 and 59A, respectively occupy the bores 36 and 36A and are backed by plates 61 and 61A which are in turn held in position by adjustment screws 62 and 62A mounted in the plugs 63 and 63A which are threadedly received into the threaded portions 39, 39A above mentioned. Said springs bear through the washers 64 and 64A against the strain gauge sensors 66 and 66A which in turn bear against the extensions 58 and 58A. Thus, appropriate adjustment of the screws 62 and 62A, locked as desired by the nuts 67 and 67A, will select the pressure imposed by the springs onto the sliders 51 and 51A and the amount of such pressure will be indicated by the strain gauge sensors 66 and 66A. The output of said strain gauge sensors may be utilized as desired, such as activating an appropriate dial or other indicator.

Figure 2:
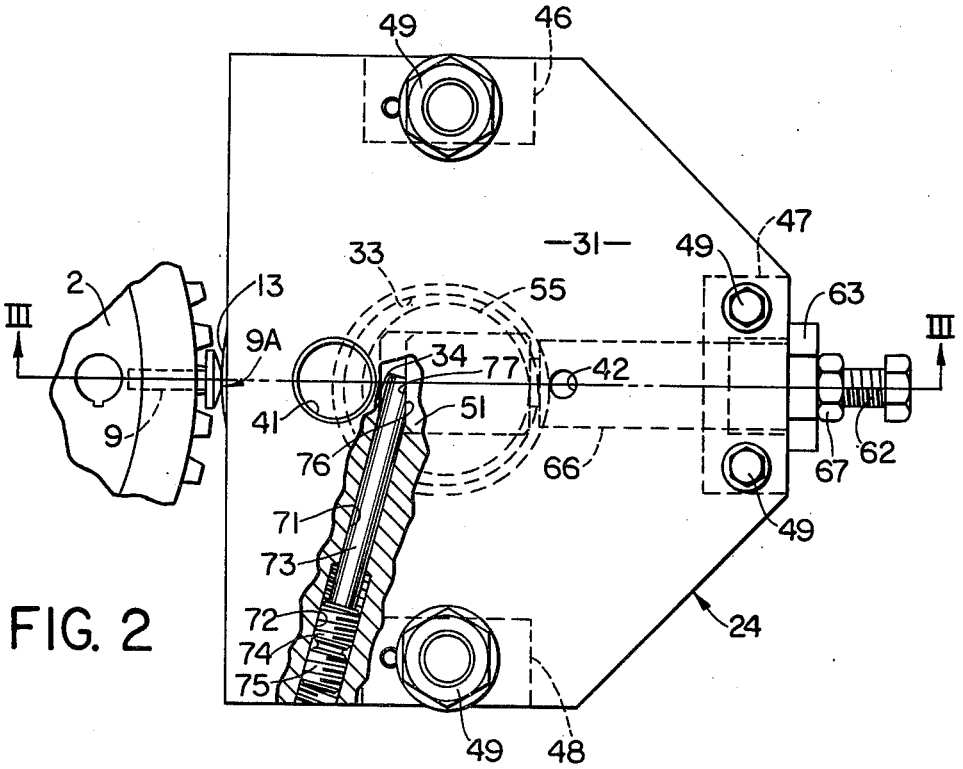
FIG. 2 is a generally plan, but partially sectional, view taken on the line II—II of FIG. 1.

Extending into the side of the upper block 31 is a bore 71 (FIG. 2) which extends from the outside of said block into the opening 34. The outer end of said bore 71 is threaded as at 72. A pin 73 is slidably received into said bore 71 and is backed by a first threaded nut 74 for accurate and infinite adjustment therein. A second threaded nut 75 acts against the first threaded nut as a lock nut. The inner end face 76 of said pin 73 bears against the face 77 of slider 51 for limiting the distance said slider can travel in response to the pressure of the spring 59. Suitable sloping of the contacting face 76 is provided to effect a wedging action for improving the operation of slider 51.

A similar opening and pin arrangement (of which only opening 72A, the pin 73A and threaded nut 75A are shown) is provided in the block 32 for similarly bearing against the slider 51A. Thus, by appropriate adjustment of the pin 73 and its counterpart 73A in block 32, the amount by which the roller 13 will project toward the table 2 in its inactive condition can be accurately determined and controlled. This will of course be determined by the radial position of the outer surface 9A of the radial punch 9 and the distance which it is desired to have said punch move toward the die 1 upon contact therewith by the roller 13. Normally said punch 9 will move only a few, as two or three, thousandths of an inch, and hence the roller 13 will move radially only a similar distance, namely merely enough to transfer the spring pressure bearing onto the sliders 51 and 51A from the pin 73 and its counterpart 73A in block 32 to the surface 9A of punch 9. Thus, by causing no appreciable further compression of the springs 59 and 59A when the punch 9 engages the roller 13, the pressure indicated by the sensors 66 and 66A in the at rest position for the roller 13 will be substantially the pressure applied by said roller onto the punch 9.

OPERATION

While the operation has been generally indicated above, same will be reviewed here to insure completeness of understanding of the invention.

Powder for compressing to a pharmaceutical tablet is placed into the die cavity 3 in a conventional manner and the punches 4 and 6 operated, likewise in a conventional manner, by the rollers 11 and 12 to compress said powders as is already known.

Simultaneously with such actuation of the punches 4 and 6, the punch 9 is actuated by the roller 13 in the manner set forth in the above-identified application for imposing a circumferentially evenly distributed, radially and inwardly directed, force against the powders within the die cavity 3, for the prevention of capping and/or laminating.

In considering the operation of the roller 13, the pin 73 and its counterpart 73A in the block 32 are first adjusted to permit the sliders 51 and 51A to move toward the table 2 sufficiently to cause the roller 13 to project toward said table a predetermined amount. Said amount will be determined by the radial position of the surface 9A of the radial punch 9 when the punch is moved radially inwardly of the table 2 sufficiently to impose a desired radial pressure onto the powders being compressed. With the pin 73 and its above-identified counterpart 73A properly adjusted, the screws 62 and 62A are advanced sufficiently to cause the springs 59 and 59A to impose onto the sliders 51 and 51A, and thereby onto the roller 13 the required amount of force for creating the desired amount of pressure on the punch 9. Since the movement of the sliders 51 and 51A toward the table 2 are limited by the pin 73 and its counterpart 73A in block 32, and since said pins have already been adjusted for the desired radial positioning of the roller 13, said force can be generated merely by appropriate advancing of the screws 62 and 62A. The force so generated is read by whatever indicator is provided to respond to the output of the strain sensors 66 and 66A.

When the table 2 rotates and the surface 9A of the punch 9 contacts the roller 13, it will cause same to move away from the table 2 sufficiently to transfer the force opposing the springs 59, 59A from the pin 73 and its counterpart 73A to said punch 9. Said movement is, however, so slight that the amount of force generated by said springs remains virtually unchanged. Thus, the force applied to the powder within the die cavity 3 is still essentially the same as that indicated by the output of the strain sensors 66 and 66A when the screws 62 and 62A were adjusted.

While the specific device illustrated and described herein was designed for application to the particular model of standard rotary press above identified, it will be apparent that same may with little, if any, modification be applied to a rotary press having two compression stations and further may, by readily apparent and relatively simple modifications, be applied to a variety of other standard and well-known rotary presses.

Accordingly although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a rotary press for compressing pharmaceutical powders into tablets, said press having at least one generally cylindrical die cavity with first and second compression punches positioned and aligned to enter axially of said die cavity thereinto and a third punch arranged and cooperating with the die cavity for imposing pressure radially onto powders therewithin and including means for operating all of said punches substantially simultaneously for imposing pressure onto powder within said die cavity, the improvement in means for actuating said third punch comprising:

housing structure defining an internal chamber;

a roller for actuating said third punch within said chamber and mounting means mounting said roller for movement toward and away from said die cavity, manually adjustable means positively limiting movement of said roller toward said die cavity; and resilient means constantly urging said roller toward said die cavity.

2. The device of claim 1 wherein said housing structure comprises a pair of relatively heavy steel blocks and wherein said chamber is at least partially defined by opposed cavities within said blocks;

means holding said blocks rigidly in selected positions relative to each other;

a first segmental strain rod connecting one of said blocks to a portion of said rotary press adjacent said means operating said first punch and a second segmental strain rod connecting the other of said blocks to a base portion of said rotary press.

3. The device of claim 1 wherein said housing structure comprises a pair of relatively heavy steel blocks and wherein said chamber is at least partially defined by opposed cavities within said blocks;

means holding said blocks rigidly in selected positions relative to each other; and wherein said mounting means comprise a pair of slide blocks, bearing means within said slide blocks for rotatably supporting said roller and a slideway defined within each of said opposed cavities for slidably receiving and supporting said slide blocks.

4. The device of claim 3 wherein said manually adjustable means comprise a pair of openings in one of said steel blocks aligned respectively with said pair of slide blocks, pins in each of said openings positioned for bearing against corresponding ends of said slide blocks and infinitely adjustable means for adjusting the position of said pins and thereby adjusting the limit to which said slide blocks may approach said die cavity.

5. The device of claim 3 wherein said resilient means comprise a pair of springs positioned for bearing respectively against each of said slide blocks and infinitely adjustable means for manually selecting the compression of said springs.

6. The device of claim 5 including also a pair of strain sensors respectively positioned between each of said springs and said respective slide blocks and readout means indicating the strain to which said strain sensors are subjected.

* * * * *